US011655728B2

(12) United States Patent
Yamazaki et al.

(10) Patent No.: US 11,655,728 B2
(45) Date of Patent: May 23, 2023

(54) ROTARY MACHINE

(71) Applicant: MITSUBISHI HEAVY INDUSTRIES COMPRESSOR CORPORATION, Tokyo (JP)

(72) Inventors: Teruya Yamazaki, Hiroshima (JP); Masanori Katada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/451,905

(22) Filed: Oct. 22, 2021

(65) Prior Publication Data

US 2022/0186631 A1 Jun. 16, 2022

(30) Foreign Application Priority Data

Dec. 14, 2020 (JP) ..... JP2020-206795

(51) Int. Cl.

| | |
|---|---|
| ***F01D 17/16*** | (2006.01) |
| ***F04D 29/46*** | (2006.01) |
| ***F04D 29/56*** | (2006.01) |
| *F04D 29/057* | (2006.01) |

(52) U.S. Cl.

CPC ..... *F01D 17/162* (2013.01); *F04D 29/462* (2013.01); *F04D 29/563* (2013.01); *F05D 2220/32* (2013.01); *F05D 2250/51* (2013.01)

(58) Field of Classification Search

CPC ..... F04D 29/462; F01D 17/162

See application file for complete search history.

(56) References Cited

U.S. PATENT DOCUMENTS

| | | | | |
|---|---|---|---|---|
| 3,081,604 | A * | 3/1963 | Namisniak | F25B 49/022 62/84 |
| 3,251,539 | A | 5/1966 | Wolfe et al. | |
| 10,138,823 | B2 * | 11/2018 | Ichi | F02M 35/162 |
| 10,634,156 | B2 | 4/2020 | Hermes | |
| 10,774,677 | B2 * | 9/2020 | Hu | F04D 27/0253 |
| 2017/0114731 | A1 * | 4/2017 | Ichi | F02M 29/10 |
| 2019/0162200 | A1 * | 5/2019 | Mohtar | F04D 29/4213 |

(Continued)

FOREIGN PATENT DOCUMENTS

| | | | |
|---|---|---|---|
| DE | 967139 C | 10/1957 | |
| FR | 2513325 A1 * | 3/1983 | |
| FR | 3069020 B1 * | 8/2019 | F04D 27/0246 |

(Continued)

*Primary Examiner* — Topaz L. Elliott

(74) *Attorney, Agent, or Firm* — Osha Bergman Watanabe & Burton LLP

(57) ABSTRACT

A rotary machine includes a rotor that includes an impeller cap that regulates the movement of an impeller fixed to a rotary shaft that extends in an axial direction about the axis; a housing that covers a rotor; and an inlet guide vane that has a plurality of movable blades that extend from the housing toward an inner side in a radial direction and disposed at intervals in a circumferential direction, in which a blade tip portion, which is a tip end of the movable blade in the radial direction, is disposed on the outer side in the radial direction with respect to an outer peripheral surface of the impeller cap, and the position of at least a part of the blade tip portion in the axial direction overlaps the position of the impeller cap in the axial direction.

4 Claims, 4 Drawing Sheets

(56) References Cited

U.S. PATENT DOCUMENTS

| | | | | |
|---|---|---|---|---|
| 2019/0368374 | A1* | 12/2019 | Hu | F04D 29/685 |
| 2019/0376409 | A1 | 12/2019 | Oda | |

FOREIGN PATENT DOCUMENTS

| | | | | | |
|---|---|---|---|---|---|
| JP | 58210324 | A | * 12/1983 | ..... | F04D 29/462 |
| JP | 2003287295 | A | * 10/2003 | ..... | F04D 29/462 |
| JP | 2019173617 | A | 10/2019 | | |
| WO | 2018142606 | A1 | 8/2018 | | |

* cited by examiner

ROTARY MACHINE

BACKGROUND OF THE INVENTION

Field of the Invention

The present disclosure relates to a rotary machine.

Priority is claimed on Japanese Patent Application No. 2020-206795, filed Dec. 14, 2020, the content of which is incorporated herein by reference.

Description of Related Art

For example, a centrifugal compressor flows a working fluid inside a rotating impeller and compresses the working fluid, which is in a gaseous state, by using the centrifugal force generated when the impeller rotates. As disclosed in Japanese Unexamined Patent Publication No. 2019-173617, some such centrifugal compressors are provided with inlet guide vanes (inlet guide vanes) in order to adjust the flow rate of the working fluid introduced from the outside. In the configuration disclosed in Japanese Unexamined Patent Publication No. 2019-173617, the inlet guide vane (IGV) is disposed further upstream side in a flow direction with respect to an impeller of a stage where an inlet flow rate of the working fluid needs to be adjusted. The inlet guide vane extends from an inner peripheral surface of a housing toward an inner side of the housing in a radial direction.

SUMMARY OF THE INVENTION

However, in the configuration described in Japanese Unexamined Patent Publication No. 2019-173617, the inlet guide vane extends from the inner peripheral surface of the housing toward the inner side of the housing in the radial direction, and has a so-called cantilever shape. Therefore, when the length of the inlet guide vane in the radial direction is long, self-excited vibration (flutter) is likely to occur due to the flow of the working fluid in the housing. In the configuration described in Japanese Unexamined Patent Publication No. 2019-173617, a tip portion on the inner side of the inlet guide vane in the radial direction extends toward inner side in the radial direction rather than the outer peripheral surface of the rotary shaft. For this reason, the vane main body of the inlet guide vane becomes long, and the self-excited vibration is particularly likely to occur.

The present disclosure provides a rotary machine capable of suppressing self-excited vibration of an inlet guide vane.

A rotary machine according to the present disclosure comprises: a rotor that includes a rotary shaft that extends in an axial direction, in which an axis extends, about the axis, an impeller fixed to the rotary shaft, and an impeller cap that is disposed at an end portion of the rotary shaft and regulates the movement of the impeller in the axial direction; a housing that covers the rotor and has a suction port allowing a working fluid to flow inside the housing; and an inlet guide vane that is disposed inside the housing on a first side in the axial direction with respect to the impeller, and has a plurality of movable blades that extend from the housing toward an inner side in a radial direction around the axis and disposed at intervals in a circumferential direction about the axis, in which a blade tip portion, which is a tip end of each of the plurality of movable blades in the radial direction, is disposed on an outer side in the radial direction with respect to an outer peripheral surface of the impeller cap, and the position of at least a part of the blade tip portion in the axial direction overlaps the position of the impeller cap in the axial direction.

According to the rotary machine of the present disclosure, it is possible to suppress the self-excited vibration of the inlet guide vane and effectively suppress the generation of jet between the inlet guide vane and the impeller.

DETAILED DESCRIPTION OF THE INVENTION

Hereinafter, a mode for carrying out a rotary machine according to the present disclosure will be described with reference to the accompanying drawings. However, the present disclosure is not limited to only the embodiment.

(Configuration of Geared Compressor (Rotary Machine))

Figure 1:
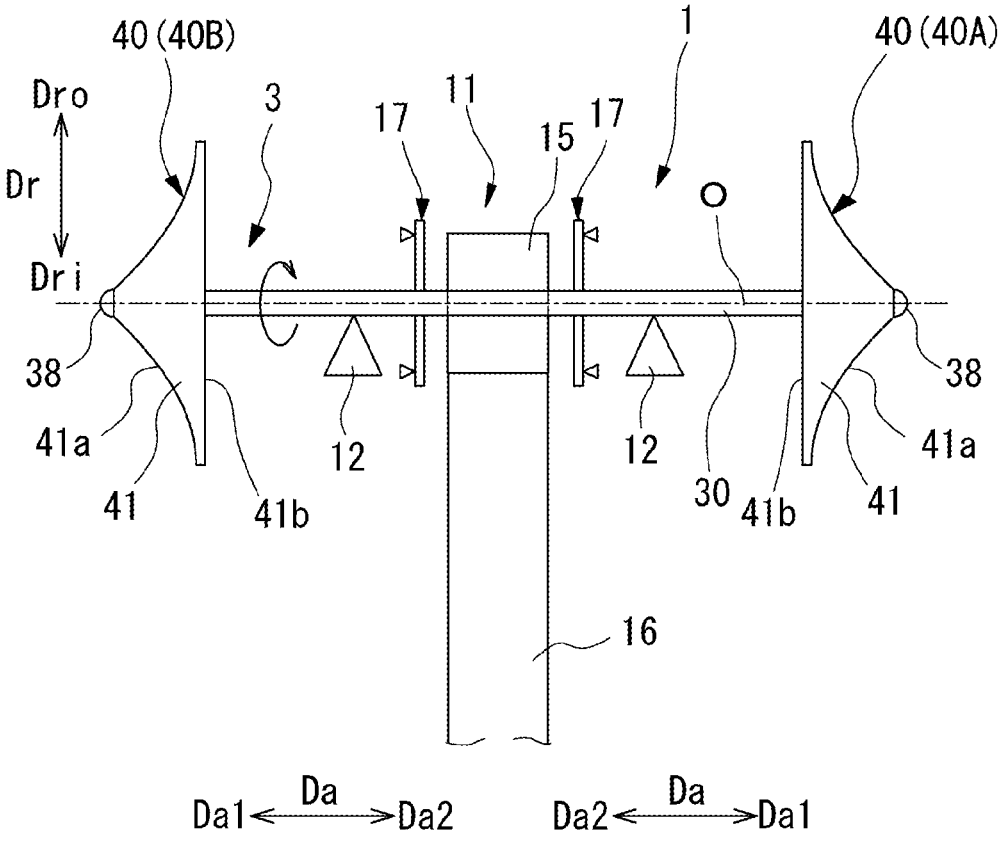
FIG. 1 is a diagram showing a schematic configuration of a rotary machine according to an embodiment of the present disclosure.
Figure 2:
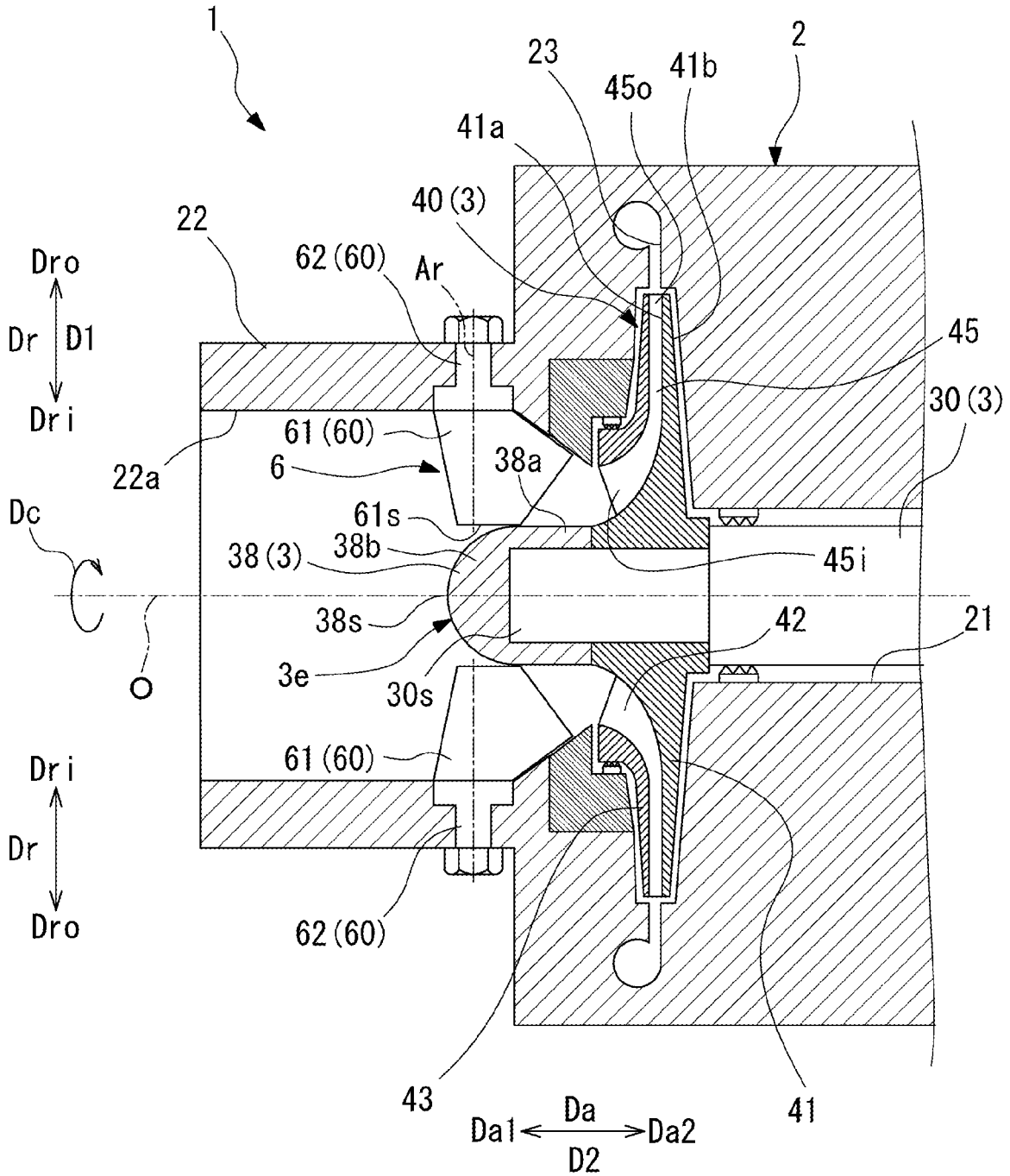
FIG. 2 is a cross-sectional view showing a configuration in which movable blades of an inlet guide vane are in a fully open state in the rotary machine.

As shown in FIGS. 1 and 2, a geared compressor (centrifugal compressor) 1 as a rotary machine according to the present embodiment mainly includes a rotor 3, a housing 2 (refer to FIG. 2), and an inlet guide vane 6 (refer to FIG. 2), a radial bearing 12, and a thrust bearing 17.

(Configuration of Rotor)

The rotor 3 is rotatable about an axis O with respect to the housing 2. The rotor 3 includes a rotary shaft 30, an impeller 40, and an impeller cap 38.

The rotary shaft 30 extends about the axis O in an axial direction Da where the axis O extends. As shown in FIG. 1, the rotary shaft 30 is rotatably supported around the axis O by a pair of radial bearings 12. The pair of radial bearings 12 is disposed at intervals in the axial direction Da. The rotary shaft 30 is restrained from moving in the axial direction Da by a pair of thrust bearings 17. The pair of thrust bearings 17 is disposed between the pair of radial bearings 12 at positions separated from each other on both sides in the axial direction Da with respect to a pinion gear 15 described later.

The rotary shaft 30 is connected to a driving source (not shown) such as an external motor via a speed increasing transmission portion 11. The speed increasing transmission portion 11 includes the pinion gear 15 and a large-diameter gear 16. The pinion gear 15 is fixed to the rotary shaft 30 between the pair of radial bearings 12. The large-diameter gear 16 meshes with the pinion gear 15. The large-diameter gear 16 is rotationally driven by the driving source. The large-diameter gear 16 is set to have a larger outer diameter than that of the pinion gear 15. Therefore, the rotation speed of the rotary shaft 30 to which the pinion gear 15 is fixed is larger than the rotation speed of the large-diameter gear 16. That is, the speed increasing transmission portion 11 accelerates the rotation speed of the large-diameter gear 16 by an external driving source via the pinion gear 15 and transmits the rotation speed to the rotary shaft 30.

The impellers 40 are disposed at both end portions of the rotary shaft 30 in the axial direction Da. As shown in FIG.

2, each impeller 40 is a so-called closed impeller including a disk 41, a blade 42, and a cover 43 in the present embodiment. The impeller 40 may be an open impeller that does not have a cover 43.

The disk 41 has a disk shape and is fixed to the rotary shaft 30.

The disk 41 has a first surface 41*a* facing the cover 43 in the axial direction Da, and a second surface 41*b* facing the side opposite to the first surface 41*a* in the axial direction Da. The second surface 41*b* is the back surface of the impeller 40. Here, as shown in FIG. 1, the geared compressor 1 is provided with one each impeller 40 at both end portions of the rotary shaft 30 in the axial direction Da in the present embodiment. Each impeller 40 is disposed in the axial direction Da such that the second surface 41*b* of the disk 41, which is the back surface, faces the pinion gear 15 and the first surface 41*a* faces the end portion of the rotary shaft 30 on the side opposite to the pinion gear 15. That is, in a first-stage impeller 40A provided at a first end of the rotary shaft 30 and a second-stage impeller 40B provided at a second end of the rotary shaft 30, the disks 41 are disposed in opposite directions in the axial direction Da such that their back surfaces face each other.

In the following description, in each impeller 40, the first surface 41*a* side of the disk 41 is referred to as the first side Da1 in the axial direction Da, and the second surface 41*b* side is referred to as the second side Da2 in the axial direction Da. That is, in the first-stage impeller 40A and the second-stage impeller 40B, the first side Da1 in the axial direction Da and the second side Da2 in the axial direction Da are opposite to each other.

As shown in FIG. 2, the blade 42 extends from the first surface 41*a* of the disk 41 to the cover 43. A plurality of blades 42 are disposed at intervals in a circumferential direction Dc around the axis O.

The cover 43 is disposed on the first side Da1 in the axial direction Da with respect to the disk 41 and the plurality of blades 42. The cover 43 has a disk shape and is formed to cover the plurality of blades 42.

The working fluid (for example, air) flows from the first side Da1 in the axial direction Da toward the second side Da2 in the axial direction Da with respect to the impeller 40. In each impeller 40, an impeller flow path 45 is formed between the disk 41 and the cover 43. The impeller flow path 45 has an inflow port 45*i* and an outflow port 45*o*. The inflow port 45*i* is open in the impeller 40 to face the first side Da1 in the axial direction Da at the inner side Dri in the radial direction Dr. Here, the radial direction Dr is a direction around the axis O. The outflow port 45*o* is open toward an outer side Dro of the impeller 40 in the radial direction Dr.

The shaft end 30*s*, which is the end portion of the rotary shaft 30 in the axial direction Da, projects to the first side Da1 in the axial direction Da with respect to the impeller 40. An impeller cap 38 is fixed to the shaft end 30*s*. The impeller cap 38 rotates together with the rotary shaft 30. The impeller cap 38 forms a rotor end portion 3*e*, which is an end portion in the axial direction Da of the rotor 3. The impeller cap 38 regulates the movement of the impeller 40 in the axial direction Da. That is, the impeller cap 38 restrains the position of the impeller 40 in the axial direction Da so as not to fall off from the rotary shaft 30.

Figure 3:
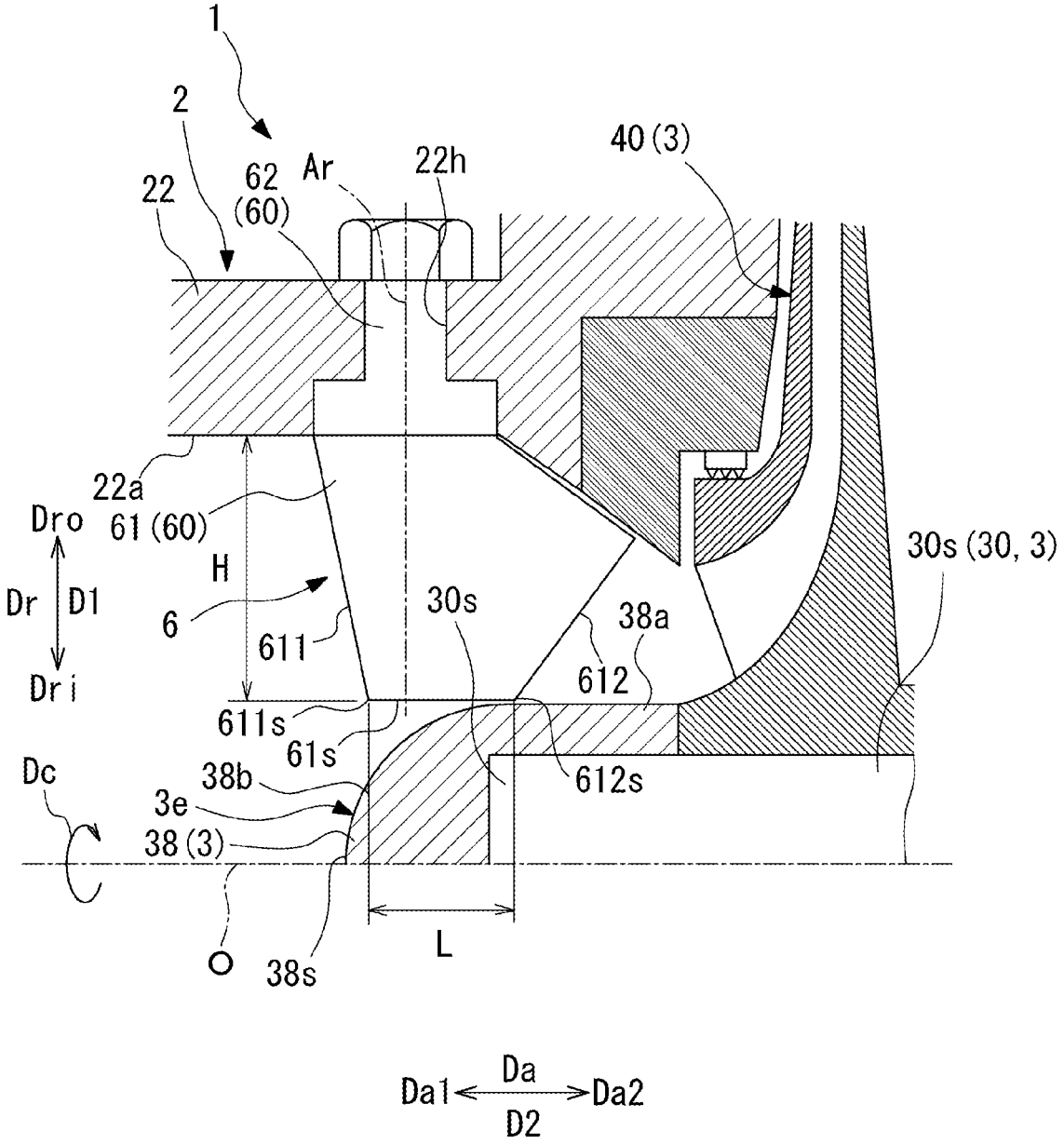
FIG. 3 is an enlarged cross-sectional view of a main part of FIG. 2.

As shown in FIGS. 2 and 3, the impeller cap 38 of the present embodiment has a tubular portion 38*a* and a cap tip portion 38*b*. The tubular portion 38*a* is formed in a cylindrical shape extending with a constant diameter in the axial direction Da about the axis O. The shaft end 30*s* of the rotary shaft 30 is inserted in the inner side of the tubular portion 38*a*. The cap tip portion 38*b* closes the end portion of the first side Da1 in the axial direction Da of the tubular portion 38*a*. That is, the cap tip portion 38*b* is disposed on the first side Da1 in the axial direction Da with respect to the tubular portion 38*a*. The cap tip portion 38*b* is formed such that the diameter gradually increases from the first side Da1 to the second side Da2 in the axial direction Da. The cap tip portion 38*b* of the present embodiment is formed, for example, in a hemispherical shape. The cap tip portion 38*b* is integrally formed with the tubular portion 38*a*.

(Configuration of Housing)

As shown in FIG. 2, the housing 2 is formed to cover the rotor 3. The housing 2 is formed of metal and forms an outer shell of the geared compressor 1. The housing 2 has a shaft insertion hole 21 through which the rotary shaft 30 is inserted on the second side Da2 in the axial direction Da with respect to the position where the impeller 40 is disposed. The housing 2 includes an intake nozzle 22 and an exhaust flow path 23 around each impeller 40.

The intake nozzle 22 causes the working fluid to flow into the housing 2. The intake nozzle 22 is formed in a tubular shape to extend in the axial direction Da. Inside the intake nozzle 22, a suction port 22*a* around the axis O is formed. The intake nozzle 22 communicates with the outside of the housing 2 and the inflow port 45*i* of the impeller flow path 45 opened to the inner side Dri in the radial direction Dr of the impeller 40 through the suction port 22*a*. When the impeller 40 rotates in the circumferential direction Dc around the axis O, the working fluid is sucked from the outside to the inside of the housing 2 through the suction port 22*a*.

The exhaust flow path 23 causes the working fluid inside the housing 2 to flow out to the outside of the housing 2. The exhaust flow path 23 is formed on the outer side Dro of the outflow port 45*o* of the impeller flow path 45 in the radial direction Dr. The exhaust flow path 23 has a spiral shape that is continuous in the circumferential direction Dc.

(Configuration of Inlet Guide Vane)

An inlet guide vane 6 controls the flow rate of the working fluid passing through the suction port 22*a*. The inlet guide vane 6 is disposed on the inner side of the intake nozzle 22 of the housing 2. That is, the inlet guide vane 6 is disposed inside the housing 2 on the first side Da1 in the axial direction Da with respect to the impeller 40. The inlet guide vane 6 has a plurality of movable blades 60. The plurality of movable blades 60 are disposed so as to project into the suction port 22*a* having a circular cross section when viewed from the axial direction Da. The plurality of movable blades 60 are disposed along the inner peripheral surface of the intake nozzle 22 at equal intervals in the circumferential direction Dc around the axis O.

The movable blade 60 is rotatable around the center axis Ar extending in the radial direction Dr. Each movable blade 60 has a blade main body 61 and a shaft portion 62. As shown in FIG. 3, each blade main body 61 extends so as to project from the inner peripheral surface of the intake nozzle 22 to a blade height direction D1, which is the extending direction (radial direction Dr) of the center axis Ar. The blade main body 61 has a blade profile in a cross-sectional shape when viewed from the radial direction Dr. Here, a blade chord direction D2, which is the direction connecting a front edge portion 611 and a rear edge portion 612 of the blade main body 61 having a blade cross-sectional shape, is orthogonal to the blade height direction D1 (radial direction Dr). The blade main body 61 is formed such that the length (chord length) of the blade chord direction D2 gradually decreases from the outer side Dro to the inner side Dri in the radial direction Dr.

The blade main body 61 has a blade tip portion 61*s* on the inner side Dri in the radial direction Dr. The blade tip portion 61*s* is a plane parallel to the axis O. That is, the blade tip portion 61*s* extends linearly so as to be parallel to the axis O in a cross-sectional view parallel to the axis O. Therefore, the blade tip portion 61*s* is not formed at an acute angle, and the chord length L in the blade chord direction D2 is formed as a surface having a constant length.

The blade tip portion 61*s* is disposed at a minute interval on the outer side Dro in the radial direction Dr with respect to the impeller cap 38. In the present embodiment, when viewed from the axial direction Da, an entire area of the movable blade 60 is disposed on the outer side Dro in the radial direction Dr rather than the position where the tubular portion 38*a* is disposed. That is, when viewed from the axial direction Da, the blade main body 61 and the impeller cap 38 do not overlap each other. Further, the position of the blade tip portion 61*s* in the radial direction Dr is preferably as close to the outer peripheral surface of the tubular portion 38*a* as possible within a range in which the movable blade 60 does not come into contact with the impeller cap 38 even when the movable blade 60 rotates.

The shaft portion 62 is formed so as to project from the blade main body 61 to the outer side Dro in the radial direction Dr. The shaft portion 62 is formed integrally with the blade main body 61. The shaft portion 62 is inserted into the shaft support hole 22*h* formed in the intake nozzle 22. The shaft portion 62 is rotatable around the center axis Ar by a blade driving device (not shown) in a state of being inserted into the shaft support hole 22*h*. As a result, the blade main body 61 can rotate around the center axis Ar integrally with the shaft portion 62. In each movable blade 60, the angle of the blade main body 61 with respect to the flow direction (axial direction Da) of the working fluid flowing through the suction port 22*a* is adjusted by rotating about the center axis Ar. The inlet guide vanes 6 are opened and closed by rotating each of the plurality of movable blades 60 about the center axis Ar.

Figure 4:
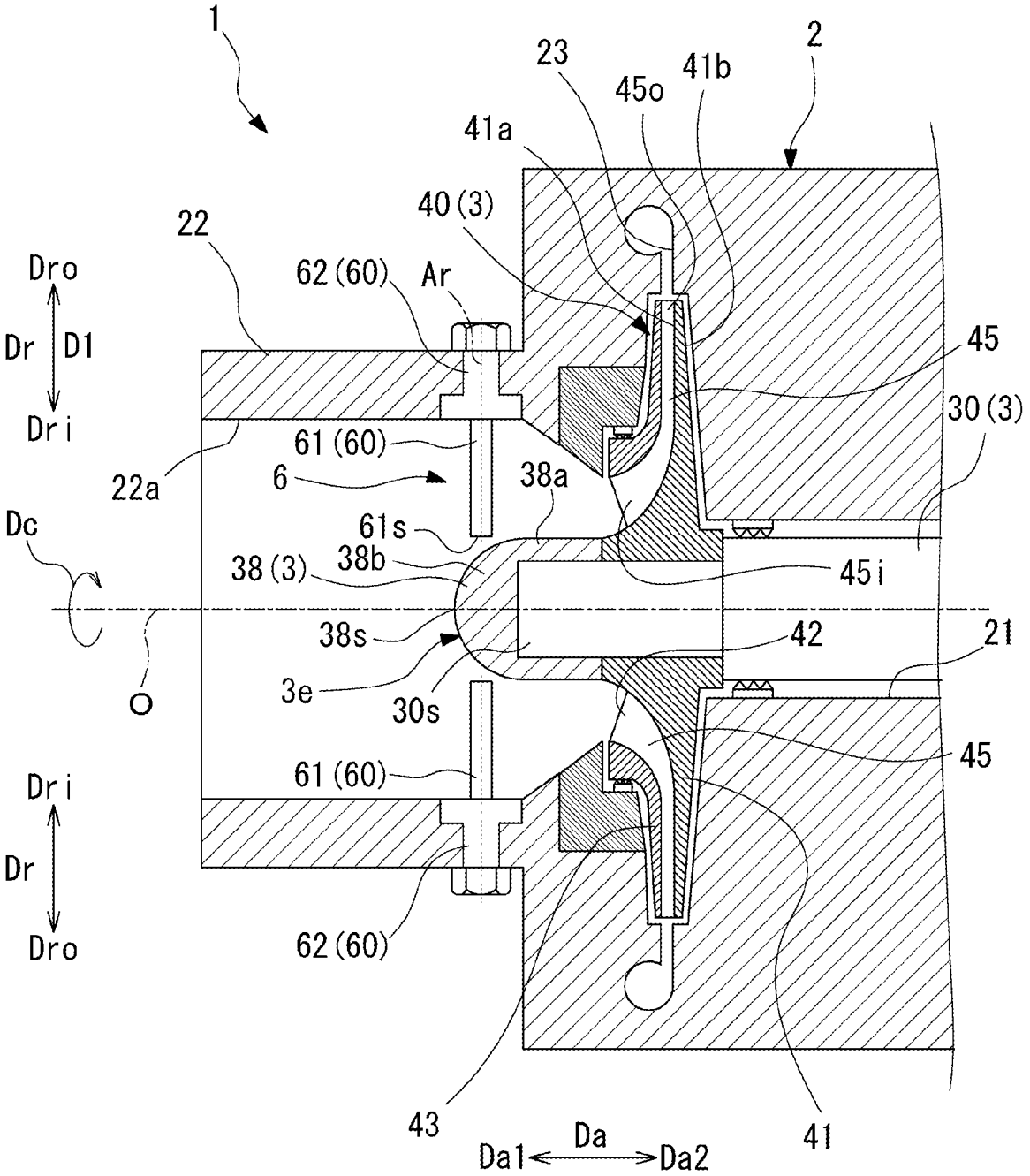
FIG. 4 is a cross-sectional view showing a configuration in which movable blades of the inlet guide vane are in a fully closed state.

Here, as shown in FIGS. 2 and 3, the state in which the blade chord direction D2 of the movable blade 60 is disposed to be parallel to the flow direction (axial direction Da) of the working fluid is defined as the fully open state of the movable blade 60. That is, the fully open state is a state in which the movable blade 60 (blade main body 61) is rotated to be the thickest in the cross-sectional view orthogonal to the axis O. When the movable blade 60 is in the fully open state, the flow rate of the working fluid passing through the suction port 22*a* is maximized. On the other hand, when the movable blade 60 is rotated around the center axis Ar from the fully open state and the blade chord direction D2 intersects the flow direction (axial direction Da) of the working fluid, the suction port 22*a* is gradually blocked by the blade main body 61. As a result, the flow rate of the working fluid flowing into the impeller 40 from the suction port 22*a* through the inlet guide vane 6 is reduced. In the present embodiment, as shown in FIG. 4, the state in which the blade chord direction D2 is orthogonal to the flow direction (axial direction Da) of the working fluid is defined as the fully closed state of the movable blade 60. That is, the fully closed state is a state in which the movable blade 60 (blade main body 61) is rotated to be the thinnest in the cross-sectional view orthogonal to the axis O.

The position of at least a part of the blade tip portion 61*s* in the axial direction Da overlaps the position of the impeller cap 38 in the axial direction Da. That is, when viewed from the radial direction Dr, a part of the blade tip portion 61*s* overlaps the impeller cap 38. In the present embodiment, the position of an entire area of the blade tip portion 61*s* in the axial direction Da overlaps the position of the impeller cap 38 in the axial direction Da.

Specifically, when the movable blade 60 is in the fully open state, a front edge portion 611*s* of the blade tip portion 61*s* is disposed on the second side Da2 in the axial direction Da with respect to the tip end 38*s* on the first side Da1 in the axial direction Da of the cap tip portion 38*b* in the axial direction Da. When the movable blade 60 is in the fully open state, the rear edge portion 612*s* of the blade tip portion 61*s* is disposed at a position overlapping the tubular portion 38*a* in the axial direction Da.

Further, as shown in FIG. 4, even when the movable blade 60 is in the fully closed state, the position of at least a part of the blade tip portion 61*s* in the axial direction Da overlaps the impeller cap 38 in the axial direction Da. In the present embodiment, when the movable blade 60 is in the fully closed state, the position of the entire area of the blade tip portion 61*s* in the axial direction Da overlaps the position of the cap tip portion 38*b* in the axial direction Da.

In such a geared compressor 1, the working fluid is sucked into the intake nozzle 22 of the housing 2 from the suction port 22*a* by rotating the impeller 40 integrally with the rotary shaft 30. In the suction port 22*a*, the flow rate of the working fluid is adjusted by an opening of the inlet guide vane 6 when the working fluid passes through the inlet guide vane 6. The working fluid passing through the inlet guide vane 6 is taken into the impeller flow path 45 from the intake nozzle 22 through the inflow port 45*i*.

The working fluid flows from the inflow port 45*i* toward the outflow port 45*o* due to the centrifugal force generated by the impeller 40 that rotates integrally with the rotary shaft 30. The working fluid is compressed while flowing from the inflow port 45*i* to the outflow port 45*o*. The compressed working fluid flows out from the outflow port 45*o* to the outer side Dro in the radial direction Dr, and is sent to the exhaust flow path 23 on the outer side Dro in the radial direction Dr. The working fluid is further compressed while swirling around the axis O along the exhaust flow path 23.

(Operational Effects)

According to the geared compressor 1 as described above, the position of the blade tip portion 61*s* of each of the plurality of movable blades 60 configuring the inlet guide vane 6 overlaps the position of the impeller cap 38 in the axial direction Da. Thereby, a blade height H, which is the length in the blade height direction D1 of the blade main body 61 in the radial direction Dr, can be shortened. The vibration of the blade main body 61 can be suppressed by shortening of the blade main body 61. Specifically, a non-dimensional frequency F of the blade main body 61 is represented by:

$$F=L\cdot\omega/V \tag{1}$$

L is a chord length at the blade tip portion 61*s* in the blade chord direction D2 of the blade main body 61, ω is a natural frequency of the blade main body 61, and V is a flow velocity of the working fluid. The natural frequency ω of the blade main body 61 is increased by shortening the blade height H of the blade main body 61. Therefore, when the blade height H of the blade main body 61 is shortened and the natural frequency ω of the movable blade 60 is increased, the non-dimensional frequency F is increased. As the non-dimensional frequency F of the movable blade 60 increases, the self-excited vibration (flutter) caused by the flow of the working fluid is less likely to occur. Therefore, since the position of the blade tip portion 61*s* overlaps the position of the impeller cap 38 in the axial direction Da, the self-excited vibration of the movable blade 60 can be suppressed due to the working fluid flowing into the housing 2 from the suction port 22*a*.

Further, the position of the blade tip portion 61*s* in the radial direction Dr is formed at the position close to the impeller cap 38 with a gap so as not to contact even when the movable blade 60 rotates. As a result, the space between the blade tip portion 61*s* and the outer peripheral surface of the impeller cap 38 becomes considerably narrow. In a case where the movable blade 60 is in the fully closed state, when viewed from the axial direction Da, although many areas of the suction port 22*a* is blocked by the blade tip portion 61*s*, an annular gap is formed between the blade tip portion 61*s* and the outer peripheral surface of the impeller cap 38. As a result, the jet may be generated by the working fluid that passes through the annular gap. When the flow velocity of the working fluid is suppressed so as to such jet does not occur, an increase in the flow rate of the centrifugal compressor is prevented. However, it is possible to prevent the working fluid from passing between the inlet guide vane 6 and the rotor end portion 3*e* by making the gap minute. Therefore, it is possible to effectively suppress the generation of the jet between the inlet guide vane 6 and the rotor end portion 3*e*.

Further, the blade tip portion 61*s* is formed as a surface parallel to the axis. As a result, the chord length L of the blade tip portion 61*s* can be longer. As a result, the non-dimensional frequency F can be increased in the above Expression (1). This can also suppress the vibration of the blade main body 61.

Further, in the inlet guide vane 6, even in the fully closed state where the blade main body 61 is the thinnest in the cross-sectional view orthogonal to the axis O, at least a part of the blade tip portion 61*s* overlaps the impeller cap 38 in the axial direction Da. That is, no matter how the movable blade 60 rotates, a part of the blade tip portion 61*s* always overlaps the impeller cap 38. As a result, the blade main body 61 is accommodated between the housing 2 and the impeller cap 38 in the radial direction Dr. As a result, the blade height H of the blade main body 61 in the radial direction Dr can be further shortened. The vibration of the blade main body 61 can be further suppressed by shortening the blade main body 61 in this manner.

Further, in the present embodiment, the position of the entire area of the blade tip portion 61*s*, not a part of the blade tip portion 61*s*, overlaps the position of the impeller cap 38 in the axial direction Da. As a result, the blade height H, which is the length in the blade height direction D1 of the blade main body 61 in the radial direction Dr, can be considerably shortened. Therefore, the blade main body 61 is shortened, and the vibration of the blade main body 61 can be effectively suppressed.

Further, when viewed from the axial direction Da, the entire area of the movable blade 60 is disposed on the outer side Dro in the radial direction Dr with respect to the impeller cap 38. That is, the entire blade main body 61 is disposed on the outer side Dro in the radial direction Dr with respect to the impeller cap 38 so as not to overlap the impeller cap 38 when viewed from the axial direction Da. As a result, the blade height H of the blade main body 61 in the radial direction Dr can be shortened. Therefore, the natural frequency of the movable blade 60 can be increased. As a result, in the above Expression (1), the non-dimensional frequency F is increased, and self-excited vibration is less likely to occur.

Other Embodiments

While preferred embodiments of the invention have been described and illustrated above, it should be understood that these are exemplary of the invention and are not to be considered as limiting. Additions, omissions, substitutions, and other modifications can be made without departing from the gist of the present invention. Accordingly, the invention is not to be considered as being limited by the foregoing description, and is only limited by the scope of the appended claims.

In the above embodiment, as an aspect of the geared compressor 1, a so-called uniaxial two-stage configuration has been described as an example. However, the aspect of the geared compressor 1 is not limited thereto, and a biaxial four-stage, or more axes and stages may be provided depending on the design and specifications.

Further, the rotary machine of the present invention is not limited to the geared compressor 1, but may be an uniaxial multi-stage flow type centrifugal compressor, or the like, a gas turbine, a steam turbine, or the like in which the rotary shaft 30 is directly rotationally driven by an external driving source.

APPENDIX

The rotary machine 1 described in the embodiment is comprehended, for example, as follows.

(1) The rotary machine 1 according to a first aspect includes a rotary machine 1 including a rotor 3 that includes a rotary shaft 30 that extends in an axial direction Da, in which an axis O extends, about the axis O, an impeller 40 fixed to the rotary shaft 30, and an impeller cap 38 that is disposed at an end portion of the rotary shaft 30 and regulates movement of the impeller 40 in the axial direction Da; a housing 2 that covers the rotor 3 and has a suction port 22*a* allowing a working fluid to be flowed inside; and an inlet guide vane 6 that is disposed inside the housing 2 on a first side Da1 in the axial direction Da with respect to the impeller 40, and has a plurality of movable blades 60 that extend from the housing 2 toward an inner side Dri in a radial direction Dr around the axis O and disposed at intervals in a circumferential direction Dc about the axis O, in which a blade tip portion 61*s*, which is a tip end of each of the plurality of movable blades 60 in the radial direction Dr, is disposed on the outer side Dro in the radial direction Dr with respect to an outer peripheral surface of the impeller cap 38, and the position of at least a part of the blade tip portion 61*s* in the axial direction Da overlaps the position of the impeller cap 38 in the axial direction Da. The rotary machine is, for example, a geared compressor, an axial centrifugal compressor, a gas turbine, a steam turbine, or the like.

In the rotary machine 1, the position of at least a part of each blade tip portion 61*s* of the plurality of movable blades 60 configuring the inlet guide vane 6 overlaps the position of the impeller cap 38 in the axial direction Da. As a result, the blade height H, which is the length in the blade height direction D1 of the movable blade 60 in the radial direction Dr, can be shortened. The vibration of the movable blade 60 can be suppressed by shortening the movable blade 60.

(2) The rotary machine 1 according to a second aspect may be the rotary machine 1 of (1), and the blade tip portion 61*s* may be a plane parallel to the axis O.

As a result, the chord length L of the blade tip portion 61*s* can be longer. As a result, the non-dimensional frequency F can be increased in the above Expression (1). Thereby, the vibration of the movable blade 60 can be suppressed.

(3) The rotary machine 1 according to a third aspect is the rotary machine 1 of (1) or (2), and each of the plurality of movable blades 60 is rotatable around a shaft portion 62 that extends in the radial direction Dr, and when the movable blade 60 is rotated to be the thinnest in a cross-sectional view orthogonal to the axis O, the position of at least a part of the blade tip portion 61*s* in the axial direction Da overlaps the position of the impeller cap 38 in the axial direction Da.

As a result, no matter how the movable blade 60 rotates, a part of the blade tip portion 61*s* always overlaps the impeller cap 38. As a result, the blade height H of the movable blade 60 in the radial direction Dr can be shorter. The vibration of the movable blade 60 can be further suppressed by shortening the movable blade 60 in this manner.

(4) The rotary machine 1 according to a fourth aspect is any one of the rotary machines 1 from (1) to (3), and a position of an entire area of the blade tip portion 61*s* in the axial direction Da overlaps the position of the impeller cap 38 in the axial direction Da.

As a result, the blade height H, which is the length in the blade height direction D1 of the movable blade 60 in the radial direction Dr, can be considerably shortened. Therefore, the movable blade 60 is shortened, and the vibration of the movable blade 60 can be effectively suppressed.

(5) The rotary machine 1 according to a fifth aspect is any one of the rotary machines 1 from (1) to (4), and when viewed from the axial direction Da, the entire area of the movable blade 60 is disposed on the outer side Dro in the radial direction Dr with respect to the impeller cap 38.

As a result, the entire movable blade 60 is disposed on the outer side Dro in the radial direction Dr with respect to the impeller cap 38 so as not to overlap the impeller cap 38 when viewed from the axial direction Da. Thereby, the blade height H of the movable blade 60 in the radial direction Dr can be shortened. As a result, the self-excited vibration is less likely to occur.

EXPLANATION OF REFERENCES

1 Geared compressor (rotary machine)
2 Housing
3 Rotor
3*e* Rotor end portion
6 Inlet guide vane
11 Speed increasing transmission portion
12 Radial bearing
15 Pinion gear
16 Large-diameter gear
17 Thrust bearing
21 Shaft insertion hole
22 Intake nozzle
22*a* Suction port
22*h* Shaft support hole
23 Exhaust flow path
30 Rotary shaft
30*s* Shaft end
38 Impeller cap
38*a* Tubular portion
38*b* Cap tip portion
38*s* Tip end
40 Impeller
40A First-stage impeller
40B Second-stage impeller
41 Disk
41*a* First surface
41*b* Second surface
42 Blade
43 Cover
45 Impeller flow path
45*i* Inflow port
45*o* Outflow port
60 Movable blade
61 Blade main body
61*s* Blade tip portion
611, 611*s* Front edge portion
612, 612*s* Rear edge portion
62 Shaft portion
Ar Center axis
D1 Blade height direction
D2 Blade chord direction
Da Axial direction
Da1 First side
Da2 Second side
Dc Circumferential direction
Dr Radial direction
Dri Inner side
Dro Outer side
H Blade height
L Chord length
O Axis

What is claimed is:

1. A rotary machine comprising:
a rotor that comprises:
a rotary shaft that extends in an axial direction in which an axis extends;
an impeller fixed to the rotary shaft; and
an impeller cap that:
is disposed at an end portion of the rotary shaft, and
regulates movement of the impeller in the axial direction;
a housing that:
covers the rotor, and
comprises a suction port allowing a working fluid to flow inside the housing; and
an inlet guide vane that:
is disposed inside the housing on a first side in the axial direction with respect to the impeller, and
comprises movable blades that:
each extend radially inward from the housing to a blade tip portion at a tip end, and
are disposed at intervals in a circumferential direction about the axis,
each blade tip portion is disposed radially outward with respect to an outer peripheral surface of the impeller cap,
an axial position of at least a part of each blade tip portion overlaps an axial position of the impeller cap,
each blade tip portion is a plane parallel to the axis,
the impeller cap comprises:
a tubular portion that is formed in a cylindrical shape with a constant radial dimension in the axial direction; and
a cap tip portion that:
closes an end portion of the tubular portion at the first side in the axial direction, and is formed such that a radial dimension gradually increases from a tip cap end at the first side to a second side at the tubular portion in the axial direction, the inlet guide vane is configured:

to rotate the movable blades such that a blade chord direction of each of the movable blades is disposed to be parallel to the axial direction in a fully open state, and to rotate the movable blades such that the blade chord direction of each of the movable blades is disposed to be orthogonal to the axial direction in a fully closed state, in the fully open state, a front edge portion of each blade tip portion is disposed on the second side in the axial direction with respect to the tip cap end, and a rear edge portion of each blade tip portion is disposed at a position overlapping the tubular portion in the axial direction, and in the fully closed state, an axial position of at least a part of each blade tip portion overlaps an axial position of the cap tip portion.

2. The rotary machine according to claim 1, wherein each of the movable blades comprises a shaft portion that extends in the radial direction of the rotor, each of the movable blades is rotatable around the shaft portion, and when each of the movable blades is rotated to be thinnest in a cross-sectional view orthogonal to the axis, the axial position of at least a part of each blade tip portion overlaps the axial position of the impeller cap.

3. The rotary machine according to claim 1, wherein an axial position of an entire area of the blade tip portion overlaps the axial position of the impeller cap.

4. The rotary machine according to claim 1, wherein, when viewed in the axial direction, an entire area of each of the movable blades is disposed radially outward with respect to the impeller cap.

* * * * *